US006475262B1

(12) United States Patent
Maulik et al.

(10) Patent No.: US 6,475,262 B1
(45) Date of Patent: Nov. 5, 2002

(54) METHOD OF FORMING A COMPONENT BY SINTERING AN IRON-BASED POWDER MIXTURE

(75) Inventors: Paritosh Maulik, Coventry (GB); Stephen Mcarthur, Coventry (GB)

(73) Assignee: Federal-Mogul Sintered Products Limited, West Midlands (GB)

( * ) Notice: Subject to any disclaimer, the term of this patent is extended or adjusted under 35 U.S.C. 154(b) by 0 days.

(21) Appl. No.: 09/381,767

(22) PCT Filed: Mar. 26, 1998

(86) PCT No.: PCT/GB98/00929

§ 371 (c)(1),
(2), (4) Date: Sep. 23, 1999

(87) PCT Pub. No.: WO98/50593

PCT Pub. Date: Nov. 12, 1998

(30) Foreign Application Priority Data

May 8, 1997 (GB) ..... 9709222

(51) Int. Cl.[7] ..... C22C 33/02

(52) U.S. Cl. ..... 75/246; 419/23; 419/38; 419/46

(58) Field of Search ..... 419/46, 23, 38; 75/246

(56) References Cited

U.S. PATENT DOCUMENTS

| | | | | | |
|---|---|---|---|---|---|
| 3,856,478 | A | * | 12/1974 | Iwata et al. | 29/182 |
| 3,982,907 | A | * | 9/1976 | Honma | 29/182.7 |
| 4,035,159 | A | * | 7/1977 | Hashimoto et al. | 75/246 |
| 4,204,031 | A | * | 5/1980 | Takemura et al. | 428/539.5 |
| 4,422,875 | A | * | 12/1983 | Nakata et al. | 75/243 |
| 5,069,867 | A | * | 12/1991 | Zengin | 419/15 |
| 5,443,787 | A | * | 8/1995 | Mori et al. | 419/32 |
| 5,512,080 | A | * | 4/1996 | Takahasi et al. | 75/231 |
| 5,870,989 | A | * | 2/1999 | Takahashi et al. | 123/188.3 |

FOREIGN PATENT DOCUMENTS

| | | | |
|---|---|---|---|
| EP | 0 266 935 | 5/1988 | C22C/33/02 |
| GB | 1281164 | 7/1972 | C22C/39/10 |
| GB | 1425495 | 2/1976 | C22C/38/12 |
| JP | 0 339 436 | 11/1989 | C22C/33/02 |
| JP | 0 604 773 | 7/1994 | C22C/33/02 |

OTHER PUBLICATIONS

Patent Abstracts of Japan, vol. 010, No. 136 (C–347), May 20, 1986 & JP 60 258449 A (Toyota Jidosha KK), Dec. 20, 1985 (see abstract).

Patent Abstracts of Japan, vol. 011, No. 262 (C–442), Aug. 25, 1987 & JP 62 063646 A (Mitsubishi Metal Corp.), Mar. 20, 1987 (see abstract).

* cited by examiner

*Primary Examiner*—Daniel J. Jenkins
(74) *Attorney, Agent, or Firm*—Synnestvedt & Lechner LLP

(57) ABSTRACT

The method comprises preparing an iron-based powder mixture, and compressing and sintering the mixture to form the component. Said mixture comprises a first powder which forms 40 to 60 wt % of the mixture and which is an atomised pre-alloy comprising nickel, cobalt and iron, a second powder which forms 30 to 50 wt % of the mixture and essentially consists of iron, a third powder which essentially consists of ferromolybdenum, a fourth powder which essentially consists of graphite, and optionally a fifth powder which consists essentially of ferrotungsten. The component has a composition comprising 5 to 11 wt % of nickel, 5 to 11 wt % of cobalt, 5 to 8 wt % molybdenum, up to 1 wt % tungsten, 0.25 to 0.9 wt % carbon, and a balance which essentially consists of iron.

7 Claims, No Drawings

METHOD OF FORMING A COMPONENT BY SINTERING AN IRON-BASED POWDER MIXTURE

This invention is concerned with a method of forming a component by a powder metallurgy route. Although this invention is useful for forming valve seat inserts for internal combustion engines, it can also be utilised for forming other components.

It is well-known to form components by a powder metallurgy route in which an iron-based powder is compacted (to form a "green body") and is then sintered. In many cases, the powder contains additional metals such as chromium, nickel, vanadium, molybdenum, tungsten, copper and cobalt which are added as elemental powder or as ferroalloys, eg ferromolybdenum (Fe—Mo), ferrovanadium (Fe—V), ferrochromium (Fe—Cr), or ferrotungsten (Fe—W), and mixed with the iron powder. Carbon powder in the form of graphite is frequently also added to the mixture, as are lubricants to assist compression. It is also known to pre-alloy some or all of the additional metals with iron in order to achieve a uniform distribution of the alloying elements. Sometimes sintering aids are also added.

Particular iron-based powder mixtures, which are used for forming valve seat inserts for internal combustion engines, can comprise 5 to 11 wt % of nickel, 5 to 11 wt % of cobalt, 5 to 8 wt % of molybdenum, 0.5 to 1.0 wt % tungsten, up to 0.55 wt % of carbon in the form of graphite powder, and a balance which essentially consists of iron and inevitable impurities. The nickel and cobalt are added to the mixture as essentially pure elemental powders, ie as pure nickel and pure cobalt, and the molybdenum and tungsten are added as ferro-alloy powders. This results in a reticular structure of interconnected regions of high alloy austenite three-dimensionally linked by lower alloy bainite, pearlite and ferrite regions. Because of the environmental hazards involved in handling fine particles of nickel and cobalt, the present applicants experimented with pre-alloying the nickel and cobalt with iron so that mixture comprised a first powder which was an atomised pre-alloy comprising nickel, cobalt and iron, a second powder which essentially consisted of ferromolybdenum, a third powder which essentially consisted of graphite, and optionally a fourth powder which essentially consisted of ferrotungsten. However, these experiments resulted in a uniform non-reticular austenitic matrix and did not result in satisfactory valve seat inserts, as the wear and heat-resistance achieved was unsatisfactory. It is believed that the uniform distribution of nickel and cobalt achieved by pre-alloying is, in this case, detrimental to the characteristics required for a valve seat insert.

It is an object of the present invention to provide a method of forming a component by a powder metallurgy route, which method enables the characteristics, normally achieved by the addition of nickel and cobalt to the powder mixture, to be achieved without adding those metals as elemental powder.

The invention provides a method of forming a component, the method comprising preparing an iron-based powder mixture, and compressing and sintering the mixture to form the component, characterised in that said mixture comprises a first powder which forms 40 to 60 wt % of the mixture and which is an atomised pre-alloy comprising nickel, cobalt and iron, a second powder which forms 30 to 50 wt % of the mixture and essentially consists of iron, a third powder which essentially consists of ferromolybdenum, a fourth powder which essentially consists of graphite, and optionally a fifth powder which essentially consists of ferrotungsten, and wherein the component has a composition comprising 5 to 11 wt % of nickel, 5 to 11 wt % of cobalt, 5 to 8 wt % molybdenum, 0.25 to 0.9 wt % carbon, up to 1 wt % of tungsten, and a balance which essentially consists of iron.

In a method according to the invention, the first powder contains a much higher quantity of nickel and cobalt than does the component formed but this is "diluted" by the unalloyed iron of the second powder. It is found that components made by this method have similar wear and heat-resisting characteristics to components formed from a powder mixture to which nickel and cobalt were added as elemental powders.

Components made by a method according to the invention have, surprisingly, been found to have an additional advantage. It is common practice to fit valve seat inserts by a cryogenic process, eg by immersing them in liquid nitrogen, and fitting them while they are very cold and, hence, of reduced size. With inserts made by a conventional method involving the use of elemental nickel and cobalt, the inserts exhibit an increased size when they return to ambient temperature. However, with inserts made by a method according to the invention, this increase is much reduced. One possible explanation is that this effect occurs because, although components made by both routes contain pearlitic and austenitic structures in their microstructure, in inserts made by the conventional route, these structures have extended grain boundaries which allow a high volume fraction of martensite to form during the cryogenic process, whereas, in the components made according to the invention, the boundaries are narrow so that a low volume of martensitic transformation occurs across the transition boundaries. The formation of extensive martensite is associated with a large size change.

Preferably, the powders consist of particles which are substantially all less than 150 microns in size. More preferably, a minimum of 80% of the particles are less than 100 microns in size.

Preferably, the carbon content of said component is 0.5 to 0.7 wt %. It is found that increased hardness can be achieved in this carbon range, when using atomised pre-alloyed powders.

For some components, eg valve seat inserts for inlet valves, said composition may contain as little as 5 wt % of nickel, and 5 wt % of cobalt.

Where the components are to withstand more exacting conditions, eg valve seat inserts for exhaust valves, said composition may contain as much as 11 wt % of nickel, and 11 wt % of cobalt. In this case, the option of up to 1 wt % of tungsten is advantageous.

It is possible for a method according to the invention to also comprise a copper infiltration process.

The mixture used in a method according to the invention may also comprise particles of a machining aid, eg manganese sulphide.

The invention also provides a component, eg a valve seat insert, made by a method according to the invention.

There now follow detailed descriptions of two examples which are illustrative of the invention.

EXAMPLE 1

In Example 1, a powder mixture was formed from powders having particles which were substantially all smaller than 150 microns (80% smaller than 100 microns). The mixture was prepared by mixing a first powder which was an atomised pre-alloy comprising nickel, cobalt and iron (nominally 12 wt % nickel, 12 wt % cobalt and a balance which essentially consisted of iron), with a second powder which essentially consisted of iron (a maximum of 1 wt % of inevitable impurities), and with a third powder which essentially consisted of ferromolybdenum (70 wt % of molybdenum), and with a fourth powder which essentially consisted of carbon in the form of graphite, and with 0.75 wt % of a standard fugitive compaction lubricant. The mixture contained 50 wt % of said first powder, 37.95 wt % of the second powder, 10.7 wt % of the third powder, and 0.6 wt % of the fourth powder.

The powder mixture was compacted into the shape of a valve seat insert by conventional pressing methods and sintered in a conventional mesh belt sintering process in a dissociated ammonia atmosphere to from valve seat inserts. The inserts had a sintered density of 6.7 g/cc and a nominal composition comprising 6 wt % nickel, 6 wt % cobalt, 7.5 wt % molybdenum, 0.6 wt % carbon and a balance which essentially consisted of iron.

The inserts were machined to an outer diameter of approximately 31.5 mm, and the outer diameter was then accurately measured. The inserts were then cooled to −196° C. by immersion in liquid nitrogen and, on returning to ambient temperature, their outer diameter was again accurately measured. The outer diameter was found to have increased by a mean of 0.005%. Thus, the inserts had good dimensional recovery characteristics. These inserts were found to exhibit suitable wear and heat resistance characteristics for use as inlet valve seat inserts of internal composition engines.

For comparison purposes, Example 1 was repeated but using a powder mixture having the same overall composition but made up from elemental powders (nickel and cobalt as elemental additions). The outer diameter of the inserts was found, after liquid nitrogen cooling, to have increased by 0.016%.

EXAMPLE 2

Example 2 repeated Example 1 except that said first powder was an atomised pre-alloy comprising nominally 18 wt % of nickel, 18 wt % of cobalt and a balance which essentially consisted of iron. Also, the second powder was reduced to 37.2 wt % to make way for 0.75 wt % of a fifth powder consisting essentially of ferrotungsten.

The valve seat inserts made according to Example 2 had a diameter of approximately 26.5 mm. The inserts were found to exhibit a mean increase in diameter of 0.008%, after liquid nitrogen cooling. Their wear and heat resistance were found to be suitable for use as exhaust valve seat inserts of an internal combustion engine.

For comparison purposes, Example 2 was repeated but using a powder mixture having the same overall composition but made up from elemental powders (nickel and cobalt as elemental additions). The outer diameter of the inserts was found, after liquid nitrogen cooling, to have increased by 0.037%.

What is claimed is:

1. A method of forming a component, the method comprising preparing an iron-based powder mixture, and compressing and sintering the mixture to form the component, wherein said mixture comprises a first powder which forms 40 to 60 wt % of the mixture and which is an atomised pre-alloy comprising nickel, cobalt and iron, a second powder which forms 30 to 50 wt % of the mixture and essentially consists of iron, a third powder which essentially consists of ferromolybdenum, a fourth powder which essentially consists of graphite, and optionally a fifth powder which essentially consists of ferrotungsten, and wherein the component has a composition comprising 5 to 11 wt % of nickel, 5 to 11 wt % of cobalt, 5 to 8 wt % molybdenum, 0.25 to 0.9 wt % carbon, up to 1 wt % of tungsten, and a balance which essentially consists of iron.

2. A method according to claim 1, wherein the powders consist of particles which are all less than 150 microns in size.

3. A method according to claim 1, wherein the carbon content of said component is 0.5 to 0.7 wt %.

4. A method according to claim 1, wherein the method also comprises a copper infiltration process.

5. A method according to claim 1, wherein the mixture also comprises particles of a machining aid.

6. A component formed by a method according to claim 1.

7. A component according to claim 6 which is formed as a valve seat insert.

* * * * *